US006447334B2

(12) United States Patent
Togashi et al.

(10) Patent No.: US 6,447,334 B2
(45) Date of Patent: Sep. 10, 2002

(54) CONNECTOR RECEPTACLE PROVIDING GOOD SHIELDING AND A TIGHT CONNECTION

(75) Inventors: Koji Togashi, Tokyo; Takayoshi Endo; Kazuaki Sakurai, both of Shizuoka, all of (JP)

(73) Assignees: SMK Corporation, Tokyo (JP); Yazaki Corporation, Tokyo (JP)

( * ) Notice: Subject to any disclaimer, the term of this patent is extended or adjusted under 35 U.S.C. 154(b) by 0 days.

(21) Appl. No.: 09/849,223

(22) Filed: May 7, 2001

(30) Foreign Application Priority Data

May 8, 2000 (JP) ..... 2000-134934

(51) Int. Cl.[7] ..... H01R 9/05

(52) U.S. Cl. ..... 439/578; 439/608; 439/680; 439/746

(58) Field of Search ..... 439/578, 607, 439/608, 609, 610, 579, 680, 746

(56) References Cited

U.S. PATENT DOCUMENTS 3,671,922 A * 6/1972 Zerlin et al. ..... 339/74 R
4,878,858 A * 11/1989 Dechelette ..... 439/607
5,445,535 A * 8/1995 Phillips, Jr. et al. ..... 439/394
5,685,745 A * 11/1997 Yamamoto et al. ..... 439/706
5,913,694 A * 6/1999 Wright ..... 439/394

FOREIGN PATENT DOCUMENTS

JP 5-31164 4/1993

* cited by examiner

*Primary Examiner*—Tho D. Ta
*Assistant Examiner*—Truc Nguyen
(74) *Attorney, Agent, or Firm*—Wenderoth, Lind & Ponack, L.L.P.

(57) ABSTRACT

A connector receptacle has an outer conductor inserted in its housing, the outer conductor having an insulator inserted in its inner space, and the insulator having a terminal piece embedded therein for connecting with a counter part. The housing has a longitudinal slot made therein, and the outer conductor includes a split conductor body having two opposite flap projections formed on its joint edges. The conductor body is inserted in the housing with the opposite flap projections press-fitted in the slot. This arrangement assures that complete shielding is provided and that the receptacle parts are tightly assembled.

7 Claims, 12 Drawing Sheets

CONNECTOR RECEPTACLE PROVIDING GOOD SHIELDING AND A TIGHT CONNECTION

BACKGROUND OF THE INVENTION

1. Field of the Invention

The present invention relates to a connector receptacle, and particularly to a shielded connector receptacle to be mated with a connector plug.

2. Related Arts

A conventional coaxial cable connector receptacle is disclosed in Japanese Utility Model H5-3 1164(A). Referring to FIG. 20A, a coaxial cable 1 comprises a core conductor 2, an insulator covering the core conductor 2, a fine-wire braided outer conductor 3 covering the insulator, and an outermost sheath covering the outer conductor 3.

A coaxial cable connector receptacle 4 is used in connecting the coaxial cable 1 with a counter part via an associated connector plug. As seen in the drawing, the coaxial cable connector 4 comprises a hollow cylinder-like housing 5, a grounding split metal cylinder 6 having engagement nails formed on its circumference, thus allowing it to be caught in the housing 5, an insulator 7 press-fitted in the grounded metal cylinder 6, and a hollow center pin 8 embedded in the insulator 7.

In fixing the coaxial cable 1 to the coaxial cable connector receptacle 4, the outermost sheath end is peeled off to expose the braided outer conductor 3, and then the braided outer conductor 3, thus exposed, is folded back onto the outermost sheath end. The so treated coaxial cable 1 is inserted in the housing 5, and then, the housing 5 is put apart from the end of the coaxial cable 1.

The insulator 7 having the hollow center pin 8 embedded therein is inserted from an opening side 6*d* of the grounding split metal cylinder 6 (FIG. 20B) so that the core conductor 2 has been press-fitted in the hollow center pin 8. Then, the insulator-and-grounding metal cylinder assembly is applied to the end of the coaxial cable 1 by inserting the end of the coaxial cable 1 in a clamp section 6*a*, and by crimping the clamp section 6*a* on the braided outer conductor 3 of the coaxial cable 1. Finally, the housing 5 is moved forward on the coaxial cable 1 until stopper flaps 6*b* of the grounding split metal cylinder 6 and a projection 7*a* of the insulator 7 have been caught by recesses 5*a* made in the inner surface of the housing 5. Thus, the grounding split metal cylinder 6 along with assembling parts are fixed firmly to the housing 5.

The grounding split metal cylinder 6 has rounded projections 11 formed on its circumference. These rounded projections are arranged at regular intervals in the vicinity of the opening side. Also, the grounding split metal cylinder 6 has a loop hole 6*e* between its opposite longitudinal edges (see FIG. 20C).

When the grounding split metal cylinder 6 is inserted into the housing 5, the loophole 6*e* and the rounded projections 11 permit the grounding split metal cylinder 6 to adapt itself to the surrounding inner wall of the housing.

This arrangement, however, allows leakage of the electromagnetic energy from the loophole, resulting in incomplete shielding.

Also, disadvantageously significant spaces are apt to be left between the stopper flaps 6*b* of the grounding split metal cylinder 6 and the recesses 5*a* formed in the inner surface of the housing 5, thus causing the grounding split metal cylinder 6 to be loosely fixed to the housing 5.

SUMMARY OF THE INVENTION

One object of the present invention is to provide a connector receptacle free of such defects as described above, assuring that complete shielding is provided and that the parts are tightly assembled.

To attain this object, a connector receptacle having an outer conductor inserted in its housing, the outer conductor having an insulator inserted in its inner space, and the insulator having a terminal piece embedded therein for connecting with a counter part, is improved according to the present invention in that the housing has a longitudinal slot made therein. Further, the outer conductor comprises a split conductor body having two opposite projections formed on its joint edges, the conductor body being inserted in the housing with the opposite projections press-fitted in the slot.

The outer conductor may comprise a split hollow cylinder having two projections formed on its opposite edges. The outer conductor may have engagement pieces formed on its circumference for fixedly holding the insulator inside. The outer conductor may have engagement projections formed on its circumference for fixedly retaining itself in the housing.

The housing may have an engagement nail formed in the vicinity of one end thereof for engaging a counter connector plug. The housing may have a hollow cylindrical space defined therein, thereby permitting the outer conductor to be inserted in the housing.

Such a connector receptacle can be used as a coaxial cable connector receptacle. It can be mounted to a round substrate.

Other objects and advantages of the present invention will be understood from a connector receptacle according to one preferred embodiment of the present invention, which is shown in accompanying drawings.

BRIEF DESCRIPTION OF THE DRAWING

FIG. 19A shows the step of inserting a semi-assembly in the housing; FIG. 19B shows the step of inserting a terminal-and-insulator combination into the outer conductor; FIG. 19C shows the step of inserting a terminal piece in the insulator; and FIG. 19D shows the terminal piece; FIG. 20A is a longitudinal section of the coaxial connector; FIG. 20B is a side view of grounding metal; and FIG. 20C is an end view of the grounding metal.

DETAILED DESCRIPTION OF PREFERRED EMBODIMENT

Figure 1:
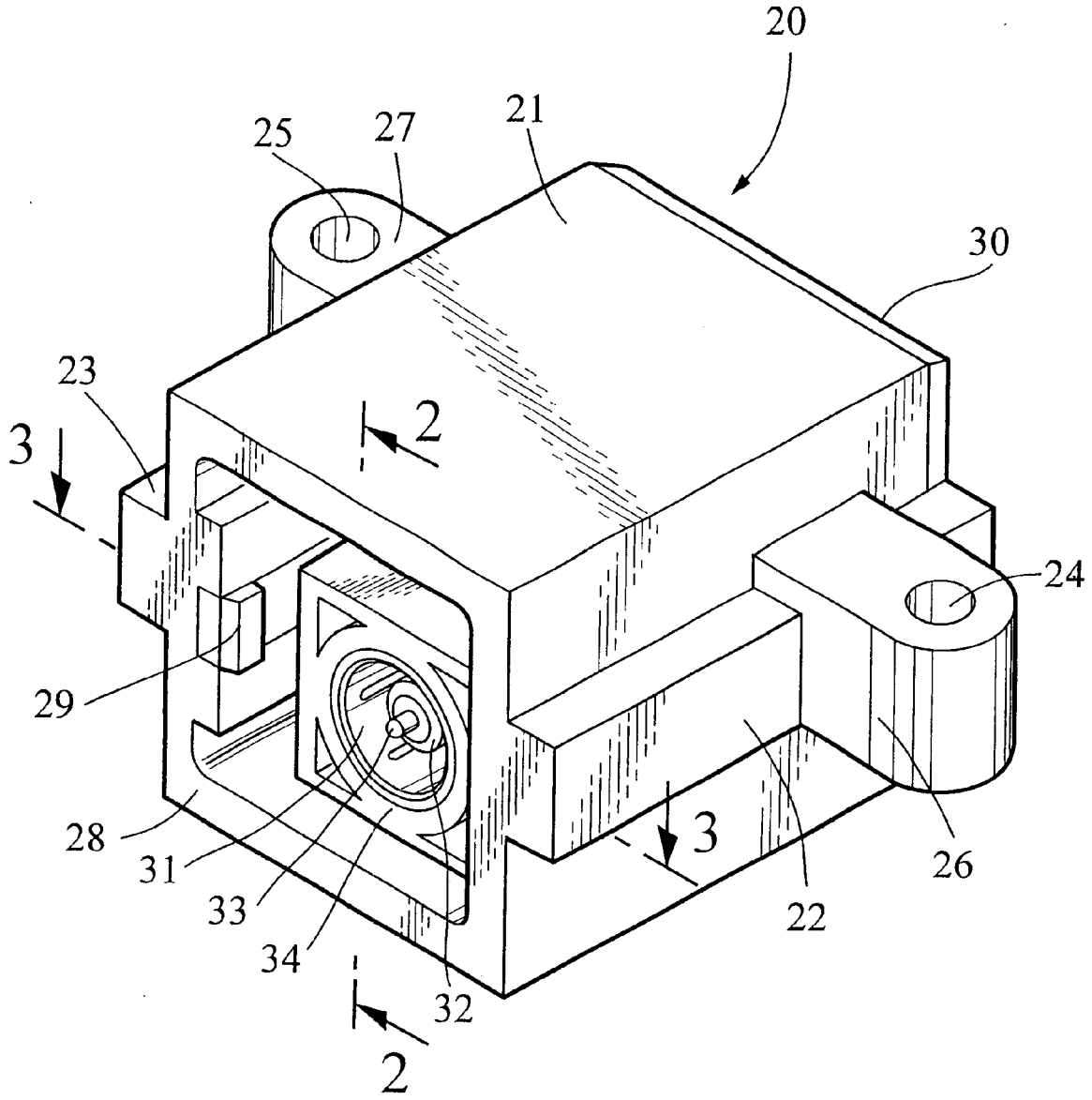
FIG. 1 is a perspective view of a connector receptacle according to the present invention as seen from the side of the receptacle connector on which a counter connector plug is inserted (plug-inserting side)
Figure 2:
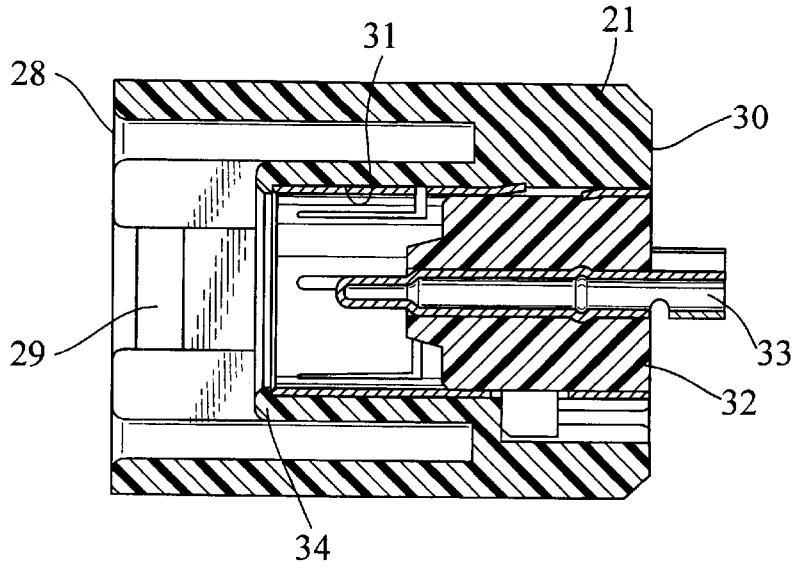
FIG. 2 is a longitudinal section taken along the line "2"—"2" in FIG. 1, and seen in the direction indicated by arrows.
Figure 3:
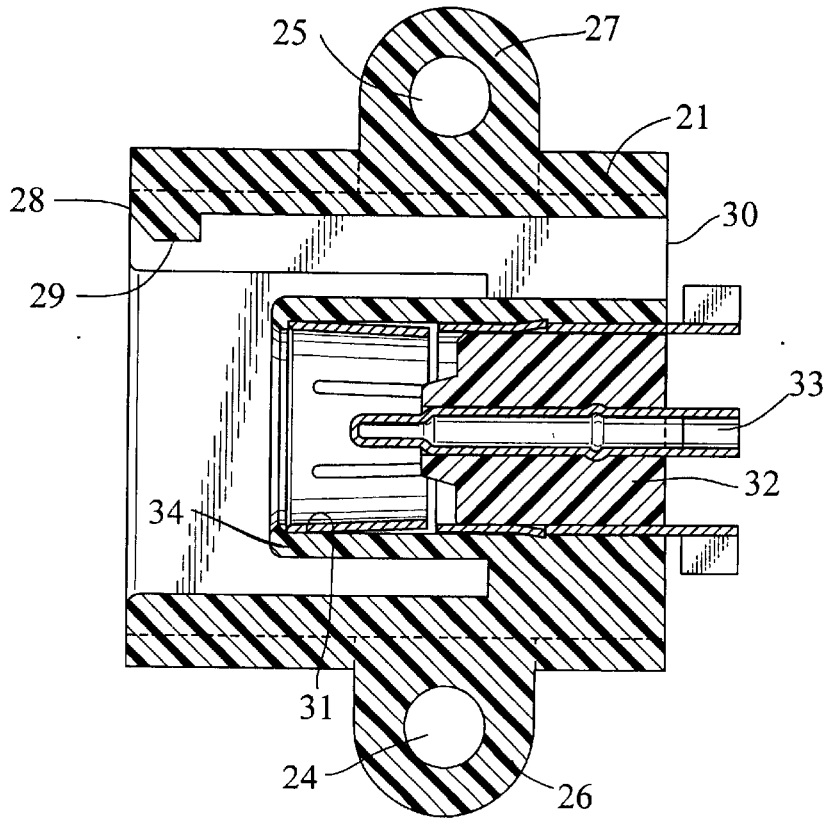
FIG. 3 is another longitudinal section taken along the line "3"—"3" in FIG. 1, and seen in the direction indicated by arrows.

Referring to FIGS. 1 to 5, a connector receptacle 20 includes a box-like housing 21, which has longitudinal rectangular plateaus 22 and round-roofed engagement projections 26 and 27 integrally connected to its opposite side walls, each round-roofed engagement projection 26 or 27 has a through hole 24 or 25 made therein.

The housing 21 has a catch nail 29 formed inside in the vicinity of a plug-inserting end 28, which is opposite to a cable-applying side 30 of the housing 21, on which an outer cable is connected to the connector receptacle.

The housing 21 has a rectangular semi-housing 34 formed inside, extending toward the plug-inserting end 28. As seen from FIGS. 2 and 3, the rectangular semi-housing 34 is integrally connected to an inward projection of the housing 21 at the cable-applying end 30.

The rectangular semi-housing 34 has a hollow cylinder formed therein. As shown, a cylindrical outer conductor 31 is inserted in the hollow cylinder of the semi-housing 34. The cylindrical outer conductor 31 reaches short of the cable-applying end 30. A cylindrical insulator 32 has a cylindrical hollow terminal piece 33 embedded therein. The cylindrical insulator 32 is inserted in the cylindrical outer conductor 31 to reach half of the way to the open end of the rectangular semihousing 34.

Figure 4:
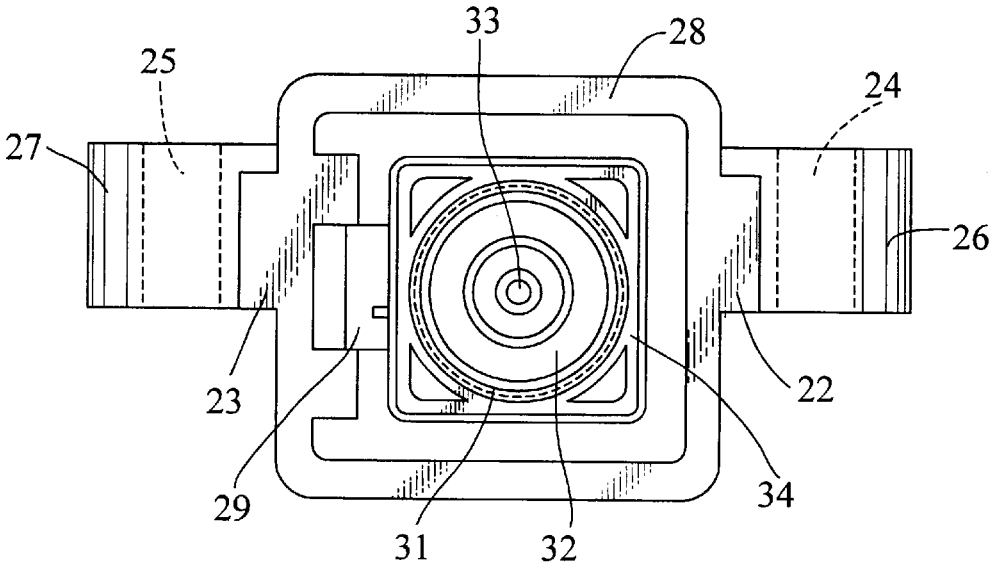
FIG. 4 is an end view of the connector receptacle, showing the plug-inserting side of the connector receptacle.
Figure 5:
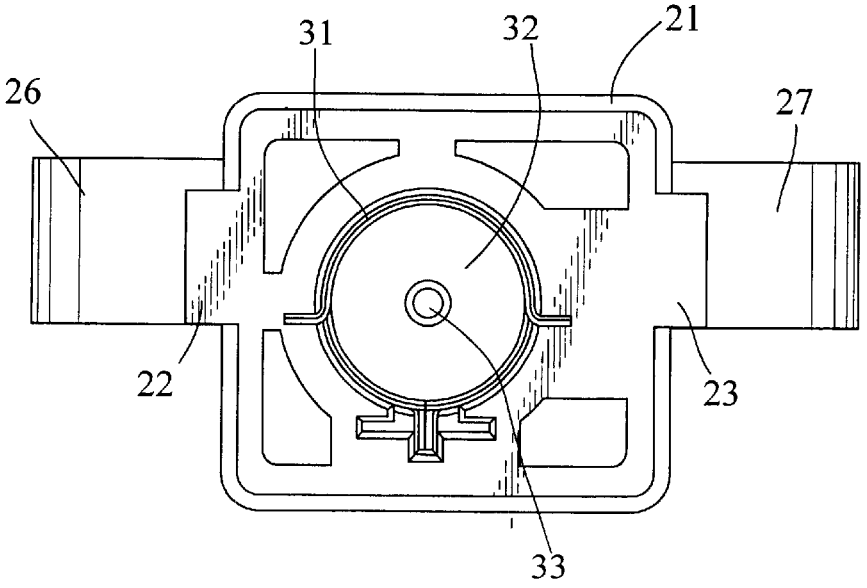
FIG. 5 is another end view of the connector receptacle, showing the side of the connector receptacle on which a coaxial cable is connected to the connector receptacle (cable-applying side)

Referring to FIG. 4, showing the receptacle connector as seen from the plug-inserting side, a counter connector plug (not shown) can be applied onto the semi-housing 34, allowing the catch nail 29 to hold the counter plug. Referring to FIG. 5, showing the receptacle connector as seen from the cable-applying side, the insulator 32 is covered and shielded by the outer conductor 31, and the hollow terminal piece 33 is embedded in the insulator 32. The hollow terminal 33 can accommodate the core conductor of a coaxial cable.

Figure 6:
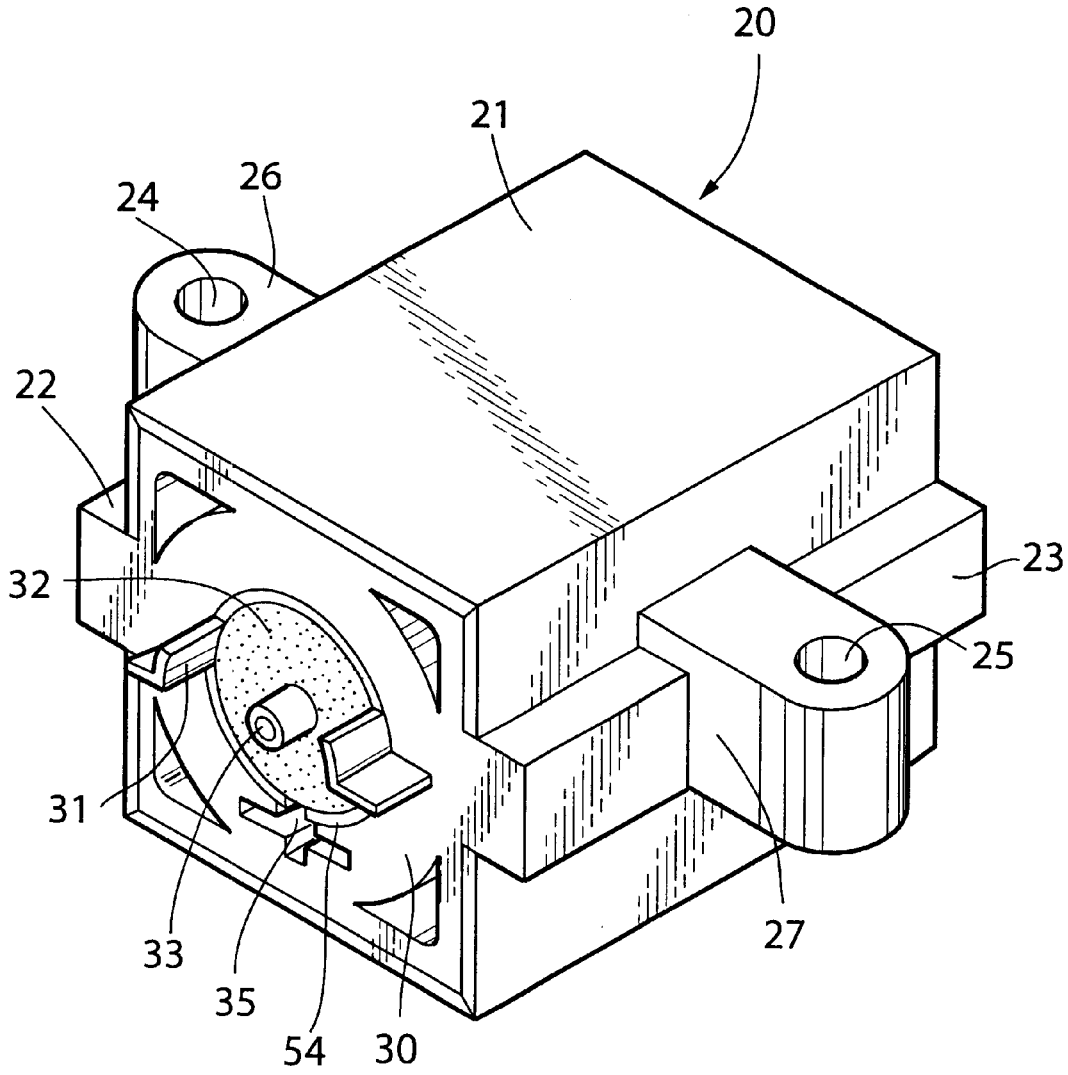
FIG. 6 is a perspective view of the connector receptacle as seen from the cable-applying side of the receptacle connector.

So far described is the connector receptacle as viewed from the plug-inserting side. Furthermore, the connector receptacle as viewed from the cable-applying side is described by referring to FIG. 6. As seen from the drawing, the hollow terminal piece 33 appears from the insulator 32, which is shielded by the outer conductor 31, and therefore, the hollow terminal piece 33 can connect the outer cable to the counter connector plug in a shielded condition.

The parts to be assembled to a connector receptacle (see FIGS. 1 and 6), i.e. the housing 21, the outer conductor 31, the insulator 32 and the terminal piece 33 are described below in detail.

Figure 7:
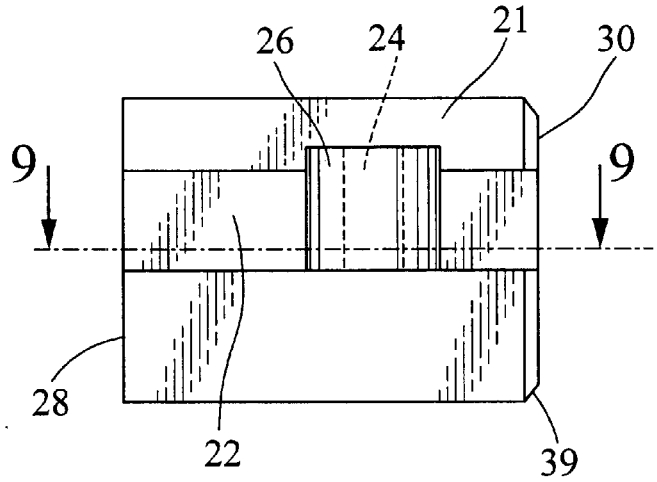
FIG. 7 is a side view of a housing of the connector receptacle.
Figure 8:
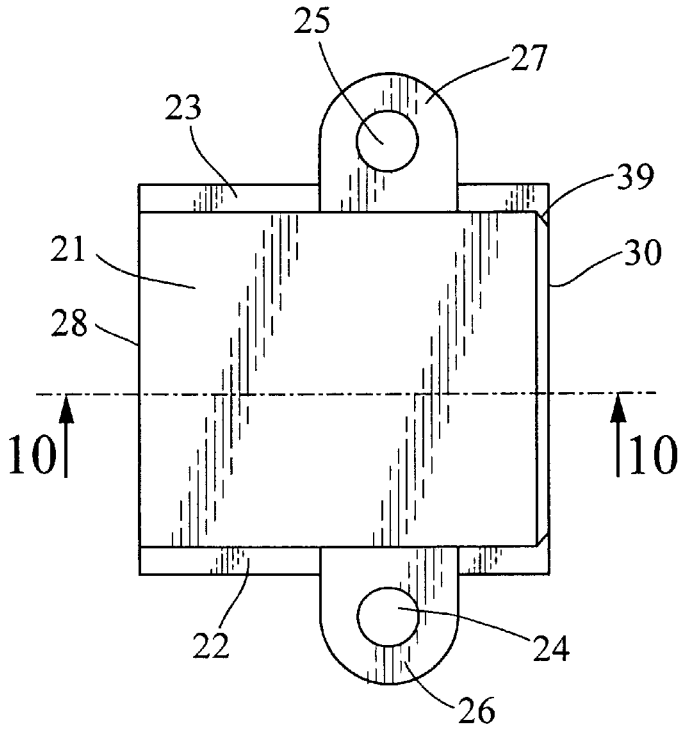
FIG. 8 is a plane view of the housing of the connector receptacle.

The housing 21 is rectangular in appearance,.and it has two opposite rectangular sides 28 (see FIG. 7) and a rectangular flat top 30 (see FIG. 8). The cable-applying end of the housing 21 is chamfered on its outer circumference as indicated by the reference numeral 39.

Figure 9:
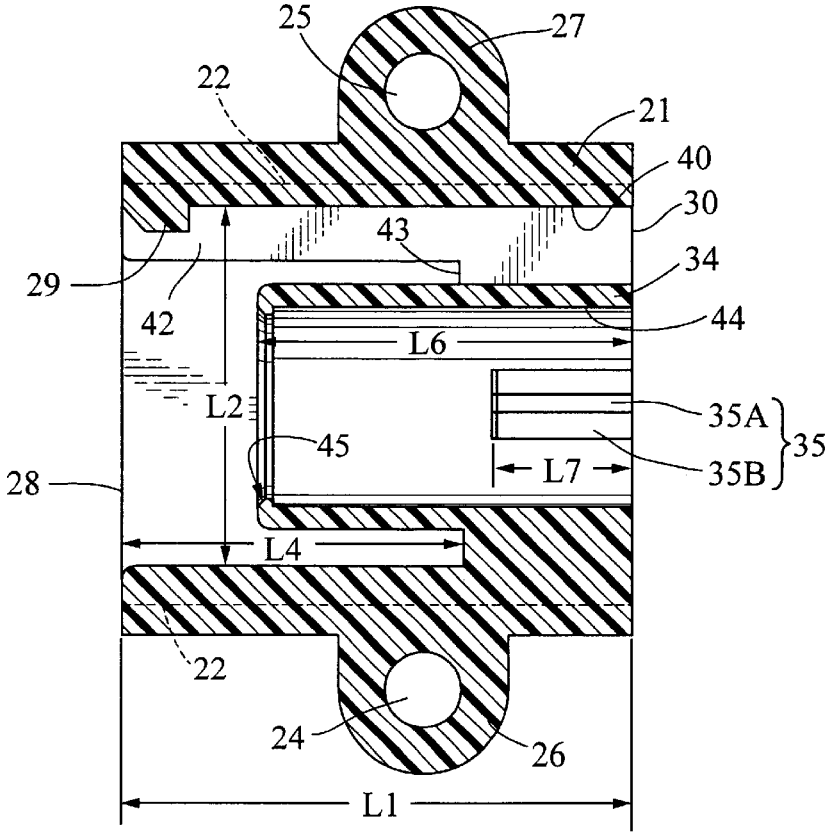
FIG. 9 is a longitudinal section of the receptacle housing taken along the line "9"—"9" in FIG. 7.
Figure 10:
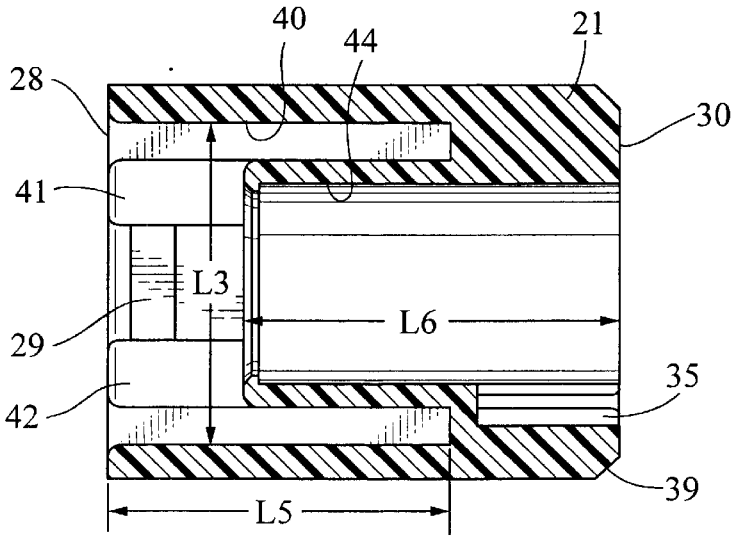
FIG. 10 is another longitudinal section of the receptacle housing taken along the line "10"—"10" in FIG. 8.

As for the inner shape of the housing 21 (see FIGS. 9 and 10), the housing 21 has a length "L1" long, and it has a rectangular space (horizontal size "L2", vertical size "L3 ", and longitudinal size "L4") defined by its opposite side walls, floor and ceiling, although a side wall 40 with the plateau-and-ear projection 23 and 27 has the catch nail 29 projecting inward, thereby reducing the horizontal size "L2" by as much as the catch nail 29 (see FIGS. 9 and 10).

The sidewall 40 with the plateau-and-ear projection 23 and 27 has upper and lower longitudinal projections 41 and 42 extending a length "L5" (="L4") toward the cable-applying end 30, and sandwiching the catch nail 29 at the plug-inserting end (see FIG. 10).

The rectangular semi-housing 34 has a hollow cylinder 44 formed inside. The hollow cylinder 44 extends a length "L6" from the cable-applying end 30 toward the plug-inserting end 28, ending with a hook-like projection 45 rising inward. The hollow cylinder 44 is integrally connected to the ceiling, the floor and the sidewall having no catch nail fixed thereto.

As seen from FIG. 9, the hollow cylinder 44 has a "T"-shaped engagement slot 35 formed on its floor. The "T"-shaped engagement slot 35 extends a length "L7" long, and it comprises two parallel shallow grooves 35B and an intervening deep groove 35A (see FIG. 6).

Figure 11:
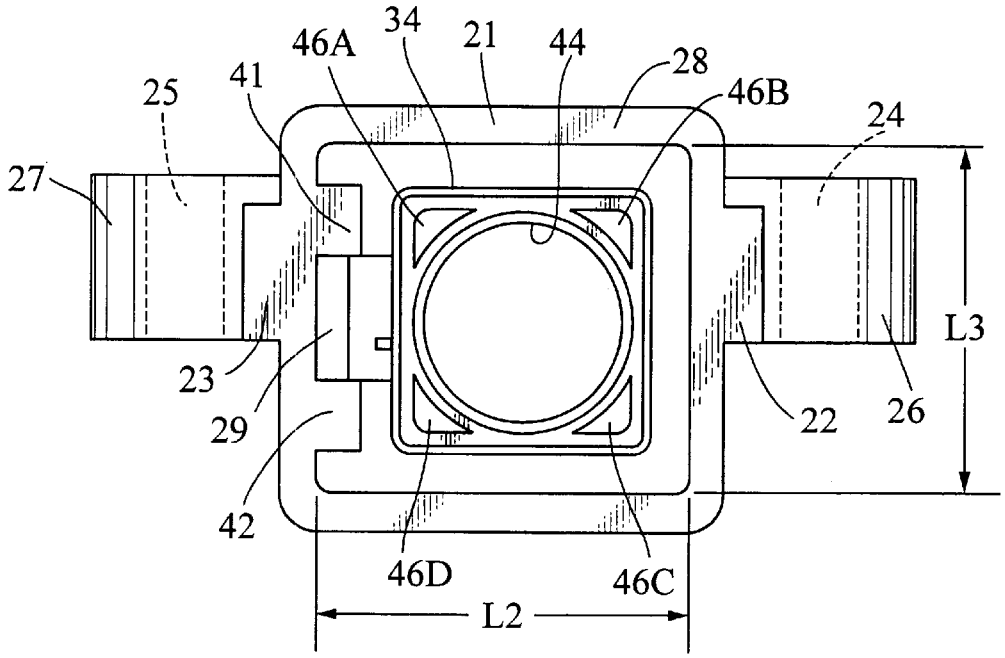
FIG. 11 is an end view of the housing as seen from the plug-inserting side of the connector receptacle.

Referring to FIG. 11, showing the connector receptacle as seen from the plug-inserting side 28, the rectangular semi-housing 34 has four triangular comer recesses 46A to 46D between the square sides 34 and the circular circumference 44.

Figure 12:
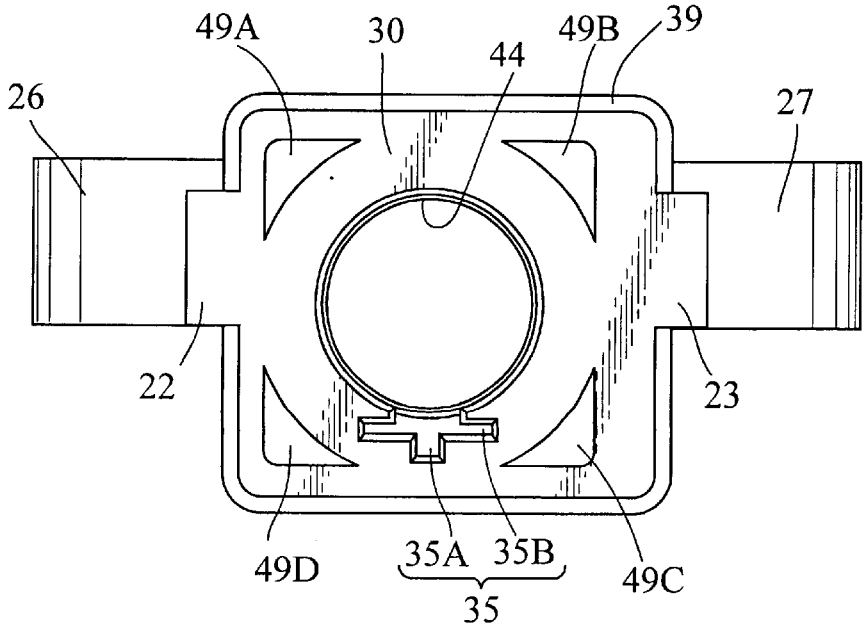
FIG. 12 is another side view of the housing as seen from the cable-applying side of the connector receptacle.

Referring to FIG. 12, showing the connector receptacle as seen from the cable-applying side 30, the rectangular housing 21 has four triangular comer recesses 49A to 49D between the square 39 and the circle 44.

Figure 13:
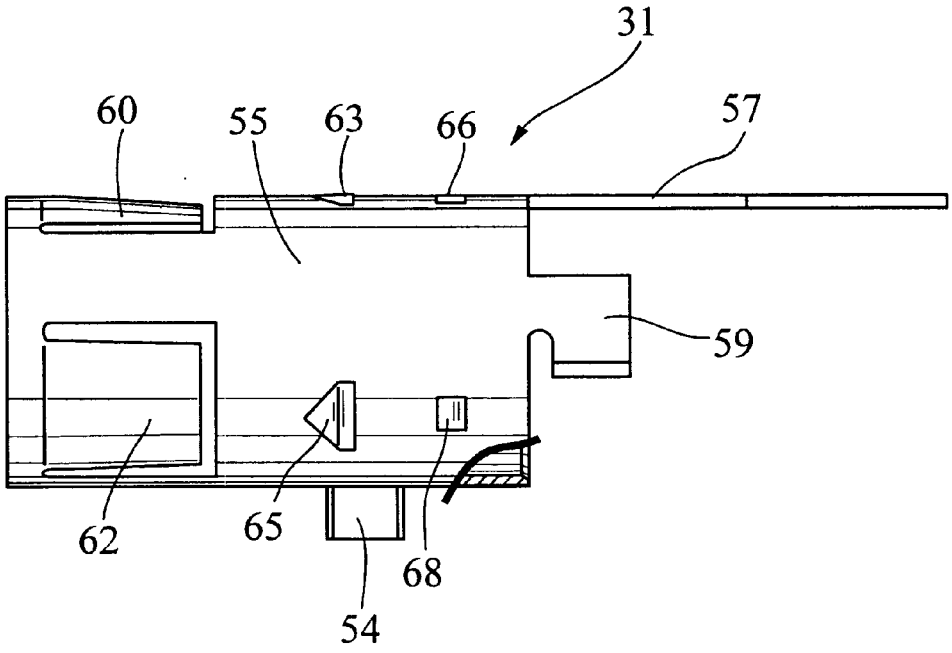
FIG. 13 is a side view of an outer conductor partly appearing in FIG. 1.
Figure 14:
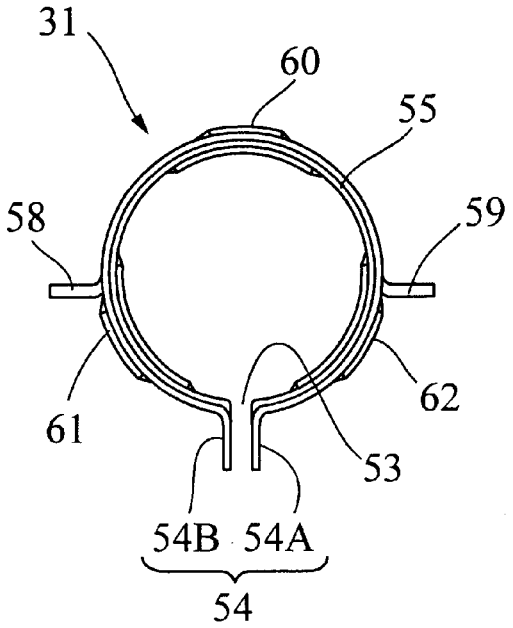
FIG. 14 is an end view of the outer conductor.
Figure 16:
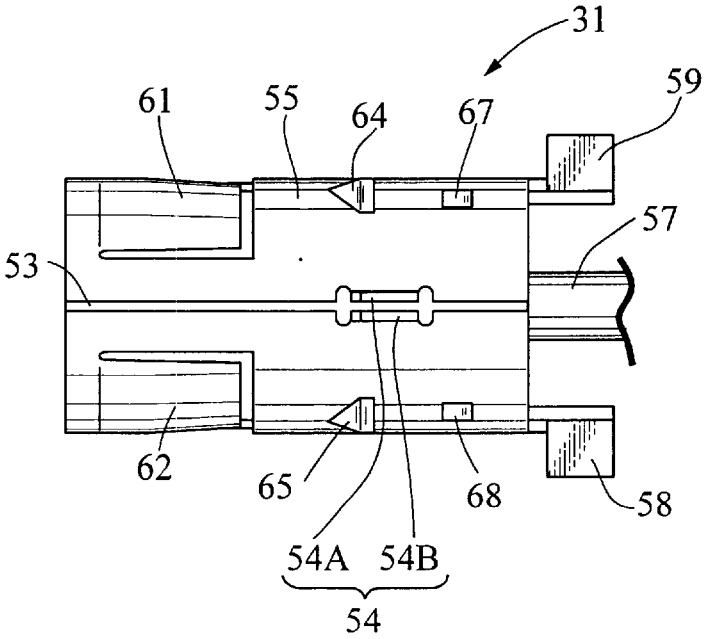
FIG. 16 is a bottom view of the outer conductor.

Referring to FIGS. 13, 14 and 16, a sheet of metal is formed into cylindrical shape, and the opposite longitudinal edges of the hollow cylinder are bent outward to form bent flaps 54A and 54B.

Figure 15:
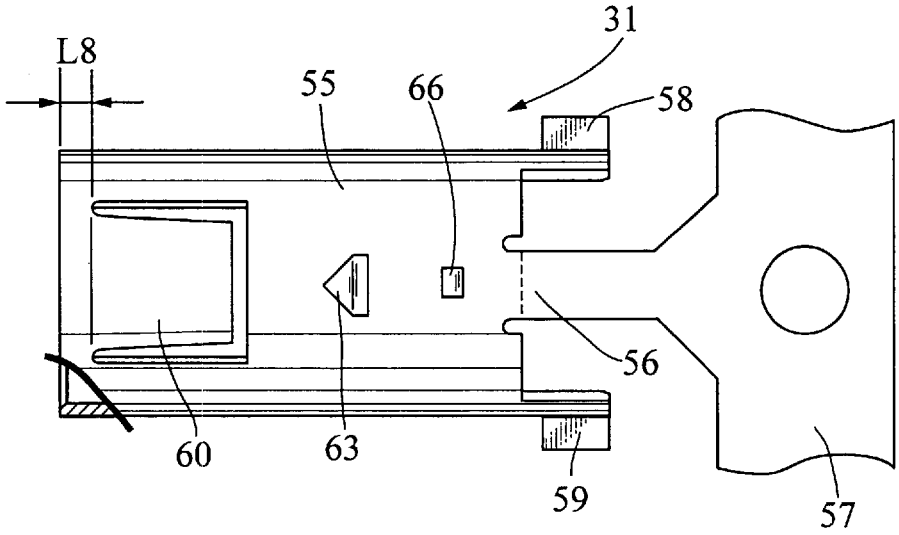
FIG. 15 is a plane view of the outer conductor.

As seen from FIG. 15, a cylindrical outer conductor 55 has a carrier strap 57 extending from one side, and the cylinder 55 has "V"-shaped cuts 56 on both sides of a bridge extension to the carrier strap 57, thereby facilitating removal of the carrier strap 57 after inserting the outer conductor 31 in the hollow cylinder 44.

As seen from FIGS. 13 to 16, the cylindrical outer conductor 55 has "L"-shaped grip pieces 58 and 59 integrally connected to the one end. These "L"-shaped grip pieces are directed toward the carrier strap 57 with their horizontal legs diametrically extending outward in opposite directions.

As seen from FIGS. 15 and 16, three flaps 60, 61 and 62 are formed to be a distance "L8" apart from the other end of the cylindrical hollow outer conductor 55 by cutting the cylinder surface at regular intervals in the form of the letter "U". These flaps 60, 61 and 62 are bent somewhat inward.

The hollow outer conductor cylinder 55 has three triangular engagement projections 63, 64 and 65 formed at regular intervals on its cylindrical surface. These triangular engagement pieces are arranged with their apexes directed to the flaps 60, 61 and 62. The triangular engagement pieces are raised somewhat on their horizontal sides.

In addition, the hollow outer conductor cylinder 55 has three rectangular engagement pieces 66, 67 and 68 formed at regular intervals on its cylindrical surface. These rectangular engagement pieces 66, 67 and 68 are arranged behind the triangular engagement projections 63, 64 and 65. Each rectangular engagement projection has three sides depressed relative to the remaining side on the cylindrical surface.

Figure 17A:
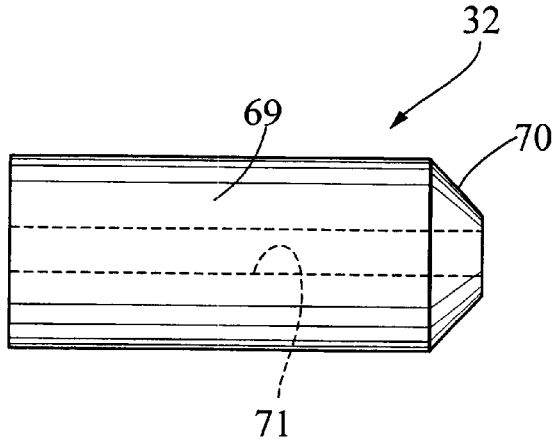
FIG. 17A is a plane view of an insulator.
Figure 17B:
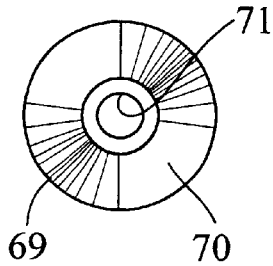
FIG. 17B is an end view of the insulator.

Referring to FIG. 17 the cylindrical insulator 32 has a frusto-conical end 70 on one side, and a through hole 71 made at its center for accommodating the terminal piece 33.

Figure 18A:
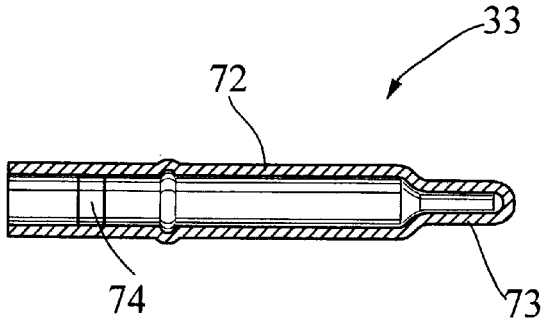
FIG. 18A is a plane view of a terminal piece.
Figure 18B:
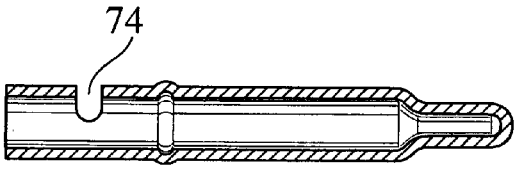
FIG. 18B is a longitudinal section of the terminal piece.

Referring to FIG. 18, the terminal piece 33 is a hollow cylinder 72 closing at its slender tip 73. The hollow cylinder 72 has a recess 74 formed a predetermined distance apart from its open end.

Figure 19A:
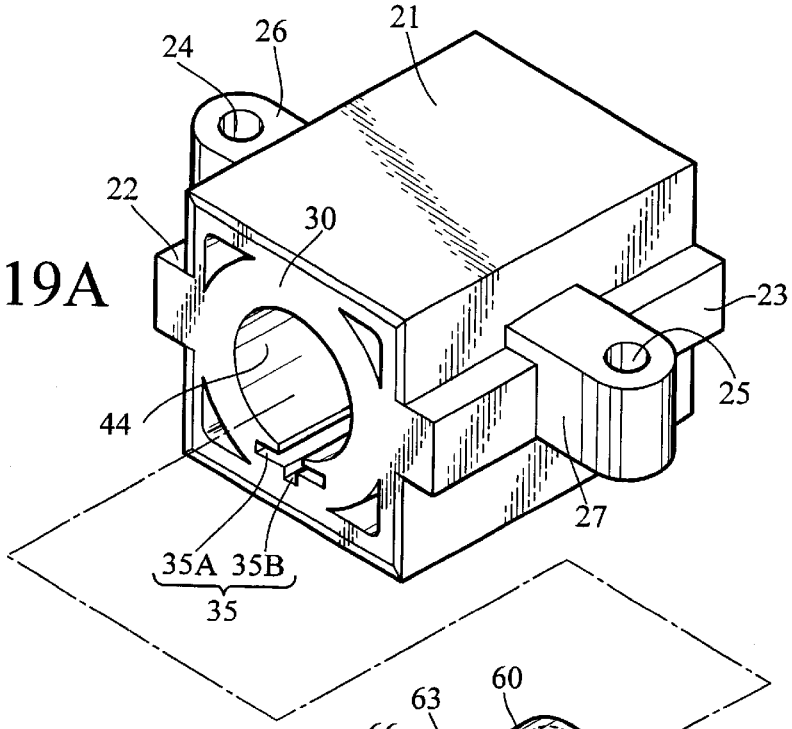
FIGS. 19A–D are an exploded view of the connector receptacle, showing sequential steps of assembling the parts to the connector plug.
Figure 19B:
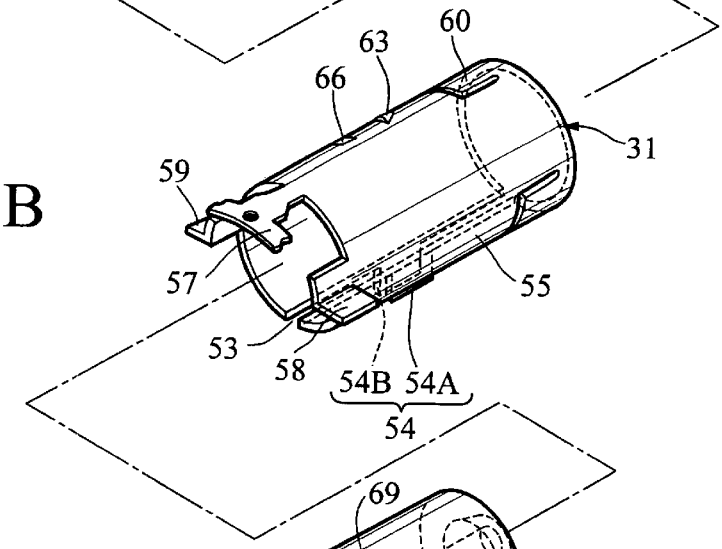
Figure 19C:
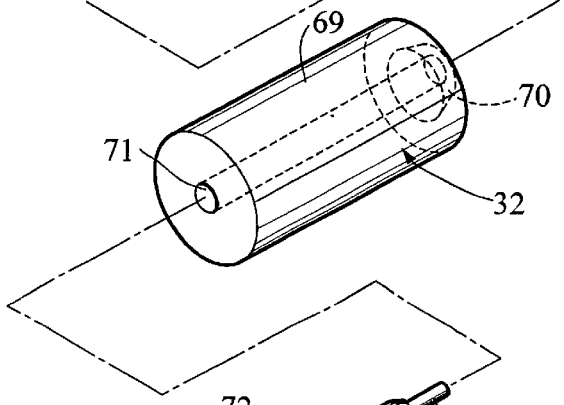
Figure 19D:
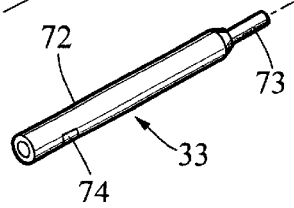
Figure 20A:
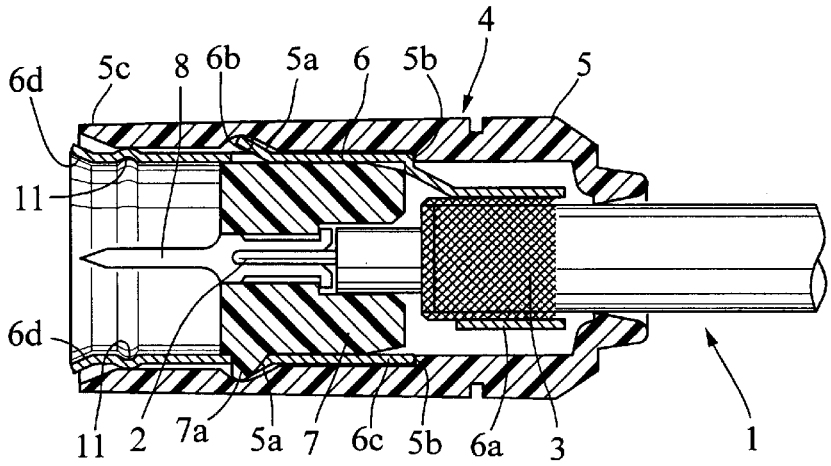
FIG.20A PRIOR ART
FIGS. 20A–C show a conventional connector receptacle.
Figure 20B:
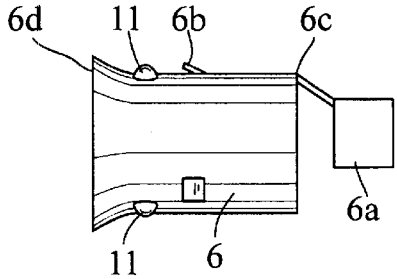
FIG.20B PRIOR ART
Figure 20C:
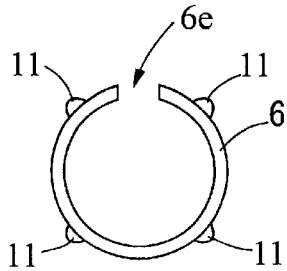
FIG.20C PRIOR ART

In assembling, these parts into a connector receptacle, first, the terminal piece 33 is inserted in the through hole 71 of the cylindrical insulator 32, as seen from FIGS. 19C and 19D. The terminal-and-insulator assembly AS is inserted in the outer conductor 31 to provide an insulator-and-outer conductor assembly BS, as seen from FIGS. 19B and 19C. Finally the insulator-and-outer conductor assembly BS is inserted in the housing 21 with its bottom flap projections 54A and 54B fitted in the "T"-shaped slot 35 of the cylinder 44, as seen from FIGS. 19A and 19B.

The total thickness of the bottom flap projections 54A and 54B is equal to the width of the intervening deep slot 35A, and the cylindrical outer conductor 31 having its opposite edges lying on each other is equal to the cylinder 44 of the housing 21 in diameter. Thus, insertion of the cylindrical outer conductor 31 with its opposite edges abutting each other will make it fit tightly in the housing 21, leaving no space between the confronting bottom flap projections 54A and 54B. This arrangement assures that the outer conductor 31 is completely closed on its split joint 53, thus providing a good shielding effect, and that the outer conductor 31 is tightly fixed to the housing, causing no looseness therebetween. Also, the insertion of the bottom flap projections 54A and 54B in the vertical slot 35A has the effect of preventing the outer conductor 31 from turning in the housing 21 when a counter plug is inserted in the receptacle.

Finally, the carrier strap 57 is removed from the finished receptacle by bending and breaking the notched portion of the carrier strap 57.

What is claimed is:

1. A connector receptacle comprising:

a housing having a substantially cylindrical inner space and a longitudinal slot outward from the substantially cylindrical inner space;

an outer substantially cylindrical hollow conductor inserted in the substantially cylindrical inner space of said housing, said outer substantially cylindrical hollow conductor comprising a split conductor body having joint edges and two opposite projections extending outward from said joint edges;

a cylindrical insulator inserted in a hollow portion of said outer substantially cylindrical hollow conductor; and a terminal piece embedded in a central portion of said cylindrical insulator, said terminal piece extending in an axial direction of said cylindrical insulator and being connectable with a counter part thereto, wherein said split conductor body is inserted in the substantially cylindrical inner space of said housing with said two opposite projections press-fitted in the longitudinal slot.

2. A connector receptacle according to claim 1, wherein said split conductor body comprises a split hollow cylinder.

3. A connector receptacle according to claim 1 wherein a circumference of said outer substantially cylindrical hollow conductor has engagement pieces formed thereon, said engagement pieces being operable to fixedly hold said cylindrical insulator inside.

4. A connector receptacle according to claim 1 wherein a circumference of said outer substantially cylindrical hollow conductor has engagement pieces formed thereon, said engagement pieces being operable to fixedly retain said outer substantially cylindrical hollow conductor in said housing.

5. A connector receptacle according to claim 1, wherein a vicinity of one end of said housing has a catch nail formed thereat, said catch nail being operable to engage a counter connector plug.

6. A connector receptacle according to claim 1, wherein said connector receptacle is operable as a coaxial cable connector receptacle.

7. A connector receptacle according to claim 1, wherein said connector receptacle is operable to be mounted to a round substrate.

* * * * *